US007425936B2

(12) United States Patent
Park

(10) Patent No.: US 7,425,936 B2
(45) Date of Patent: Sep. 16, 2008

(54) DRIVING APPARATUS FOR PLASMA DISPLAY PANEL AND A GRAY LEVEL EXPRESSING METHOD THEREOF

(75) Inventor: Seung-Ho Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 616 days.

(21) Appl. No.: 10/966,682

(22) Filed: Oct. 14, 2004

(65) Prior Publication Data

US 2005/0083263 A1 Apr. 21, 2005

(30) Foreign Application Priority Data

Oct. 16, 2003 (KR) ..... 10-2003-0072316

(51) Int. Cl.
*G09G 3/28* (2006.01)

(52) U.S. Cl. ..... 345/60; 345/63

(58) Field of Classification Search ..... 345/690, 345/60, 63

See application file for complete search history.

(56) References Cited

U.S. PATENT DOCUMENTS

| | | | | |
|---|---|---|---|---|
| 6,097,368 | A * | 8/2000 | Zhu et al. | 345/63 |
| 6,215,469 | B1 * | 4/2001 | Mori et al. | 345/60 |
| 6,323,880 | B1 * | 11/2001 | Yamada | 345/63 |
| 6,429,833 | B1 * | 8/2002 | Ryeom et al. | 345/60 |
| 6,483,492 | B1 * | 11/2002 | Takeuchi et al. | 345/690 |
| 6,697,084 | B1 * | 2/2004 | Ohmae et al. | 345/690 |
| 6,882,115 | B2 * | 4/2005 | Song | 345/690 |
| 6,882,351 | B2 * | 4/2005 | Morita | 345/690 |
| 6,909,441 | B2 * | 6/2005 | Hashimoto | 345/690 |
| 6,924,778 | B2 * | 8/2005 | Awamoto et al. | 345/690 |
| 6,989,845 | B1 * | 1/2006 | Okamoto et al. | 345/690 |
| 7,079,089 | B2 * | 7/2006 | Kwon et al. | 345/690 |
| 7,088,313 | B2 * | 8/2006 | Kang | 345/63 |
| 2002/0158819 | A1 * | 10/2002 | Lee et al. | 345/60 |
| 2003/0001871 | A1 * | 1/2003 | Morita | 345/690 |
| 2003/0076338 | A1 * | 4/2003 | Hashimoto | 345/690 |

FOREIGN PATENT DOCUMENTS

JP 10-198305 7/1998

(Continued)

OTHER PUBLICATIONS

Korean Patent Abstract 1020020014766 A, Published Feb. 25, 2002, in the name of Iwamoto.

(Continued)

*Primary Examiner*—Chanh Nguyen
*Assistant Examiner*—Adam J Snyder
(74) *Attorney, Agent, or Firm*—Christie, Parker & Hale, LLP

(57) ABSTRACT

A driving apparatus for plasma display panel and a gray level expressing method thereof that reduces pseudo-contour. A row average gray level value is calculated through simulation after displaying a test image with different gray levels, and the respective gray levels are classified into a plurality of gray level groups according to the probability of pseudo-contour. The gray level conversion is performed differently according to the plural gray level groups. The gray level values of two frames input consecutively and the illuminating patterns of the subfields are compared to detect the pseudo-contour, and the detecting result is applied to the gray level groups to perform the different gray level conversions.

11 Claims, 14 Drawing Sheets

FOREIGN PATENT DOCUMENTS

| | | |
|---|---|---|
| JP | 11-212517 | 8/1998 |
| JP | 11-231827 | 8/1999 |
| JP | 2001-34229 | 2/2001 |
| JP | 2002-82649 | 3/2002 |
| KR | 2002-0014766 | 2/2002 |
| KR | 2002-0024672 | 4/2002 |

OTHER PUBLICATIONS

Korean Patent Abstracts for Publication No. 1020020024672; Date of publication of application Apr. 1, 2002, in the name of Choon Woo Kim et al.

Patent Abstracts of Japan, Publication No. 10-198305, dated Jul. 31, 1998, in the name of Atsuhiro Yamashita.

Patent Abstracts of Japan, Publication No. 11-212517, dated Aug. 6, 1999, in the name of Isao Kawahara.

Patent Abstracts of Japan, Publication No. 11-231827, dated Aug. 27, 1999, in the name of Isao Kawahara et al.

Patent Abstracts of Japan, Publication No. 2001-034229, dated Feb. 9, 2001, in the name of Isao Kawahara.

Patent Abstracts of Japan, Publication No. 2002-082649, dated Mar. 22, 2002, in the name of Tomoko Morita et al.

* cited by examiner

Case of weight value 64, with different illuminating patterns

Case of weight value 128, with different illuminating patterns

FIG.13A

| Input | Output | | |
|---|---|---|---|
| | Gray level group 1 | Gray level group 2 | Gray level group 3 |
| 0 | 0 | 0 | 0 |
| 1 | 1 | 1 | 1 |
| 2 | 2 | 1 | 1 |
| 3 | 3 | 3 | 3 |
| 4 | 4 | 3 | 3 |
| 5 | 5 | 5 | 3 |
| 6 | 6 | 5 | 7 |
| 7 | 7 | 7 | 7 |
| 8 | 8 | 7 | 7 |
| 9 | 9 | 7 | 7 |
| 10 | 10 | 11 | 7 |
| 11 | 11 | 11 | 15 |
| 12 | 12 | 11 | 15 |
| 13 | 13 | 11 | 15 |
| 14 | 14 | 15 | 15 |
| 15 | 15 | 15 | 15 |
| 16 | 16 | 15 | 15 |
| 17 | 17 | 15 | 15 |
| 18 | 18 | 15 | 15 |
| 19 | 19 | 15 | 15 |
| 20 | 20 | 23 | 15 |
| 21 | 21 | 23 | 15 |
| 22 | 22 | 23 | 15 |
| 23 | 23 | 23 | 31 |
| 24 | 24 | 23 | 31 |
| 25 | 25 | 23 | 31 |
| 26 | 26 | 27 | 31 |
| 27 | 27 | 27 | 31 |
| 28 | 28 | 27 | 31 |
| 29 | 29 | 27 | 31 |
| 30 | 30 | 31 | 31 |
| 31 | 31 | 31 | 31 |
| 32 | 32 | 31 | 31 |
| 33 | 33 | 31 | 31 |
| 34 | 34 | 31 | 31 |
| 35 | 35 | 31 | 31 |
| 36 | 36 | 31 | 31 |
| 37 | 37 | 31 | 31 |
| 38 | 38 | 43 | 31 |
| 39 | 39 | 43 | 47 |
| 40 | 40 | 43 | 47 |
| 41 | 41 | 43 | 47 |
| 42 | 42 | 43 | 47 |
| 43 | 43 | 43 | 47 |
| 44 | 44 | 43 | 47 |
| 45 | 45 | 47 | 47 |
| 46 | 46 | 47 | 47 |
| 47 | 47 | 47 | 47 |

FIG.13B

| Input | Output | | |
|---|---|---|---|
| | Gray level group 1 | Gray level group 2 | Gray level group 3 |
| 48 | 48 | 47 | 47 |
| 49 | 49 | 47 | 47 |
| 50 | 50 | 47 | 47 |
| 51 | 51 | 55 | 47 |
| 52 | 52 | 55 | 47 |
| 53 | 53 | 55 | 47 |
| 54 | 54 | 55 | 47 |
| 55 | 55 | 55 | 63 |
| 56 | 56 | 55 | 63 |
| 57 | 57 | 59 | 63 |
| 58 | 58 | 59 | 63 |
| 59 | 59 | 59 | 63 |
| 60 | 60 | 59 | 63 |
| 61 | 61 | 63 | 63 |
| 62 | 62 | 63 | 63 |
| 63 | 63 | 63 | 63 |
| 64 | 64 | 63 | 63 |
| 65 | 65 | 63 | 63 |
| 66 | 66 | 63 | 63 |
| 67 | 67 | 63 | 63 |
| 68 | 68 | 73 | 63 |
| 69 | 69 | 73 | 63 |
| 70 | 70 | 73 | 63 |
| 71 | 71 | 73 | 63 |
| 72 | 72 | 73 | 63 |
| 73 | 73 | 73 | 63 |
| 74 | 74 | 73 | 63 |
| 75 | 75 | 73 | 63 |
| 76 | 76 | 73 | 89 |
| 77 | 77 | 73 | 89 |
| 78 | 78 | 73 | 89 |
| 79 | 79 | 85 | 89 |
| 80 | 80 | 85 | 89 |
| 81 | 81 | 85 | 89 |
| 82 | 82 | 85 | 89 |
| 83 | 83 | 85 | 89 |
| 84 | 84 | 85 | 89 |
| 85 | 85 | 85 | 89 |
| 86 | 86 | 85 | 89 |
| 87 | 87 | 85 | 89 |
| 88 | 88 | 89 | 89 |
| 89 | 89 | 89 | 89 |
| 90 | 90 | 89 | 89 |
| 91 | 91 | 89 | 89 |
| 92 | 92 | 89 | 89 |
| 93 | 93 | 97 | 89 |
| 94 | 94 | 97 | 89 |

FIG.13C

| Input | Output | | |
|---|---|---|---|
| | Gray level group 1 | Gray level group 2 | Gray level group 3 |
| 95 | 95 | 97 | 89 |
| 96 | 96 | 97 | 89 |
| 97 | 97 | 97 | 105 |
| 98 | 98 | 97 | 105 |
| 99 | 99 | 101 | 105 |
| 100 | 100 | 101 | 105 |
| 101 | 101 | 101 | 105 |
| 102 | 102 | 101 | 105 |
| 103 | 103 | 105 | 105 |
| 104 | 104 | 105 | 105 |
| 105 | 105 | 105 | 105 |
| 106 | 106 | 105 | 105 |
| 107 | 107 | 105 | 105 |
| 108 | 108 | 105 | 105 |
| 109 | 109 | 105 | 105 |
| 110 | 110 | 105 | 105 |
| 111 | 111 | 105 | 105 |
| 112 | 112 | 117 | 105 |
| 113 | 113 | 117 | 105 |
| 114 | 114 | 117 | 105 |
| 115 | 115 | 117 | 105 |
| 116 | 116 | 117 | 105 |
| 117 | 117 | 117 | 105 |
| 118 | 118 | 117 | 133 |
| 119 | 119 | 117 | 133 |
| 120 | 120 | 117 | 133 |
| 121 | 121 | 117 | 133 |
| 122 | 122 | 117 | 133 |
| 123 | 123 | 117 | 133 |
| 124 | 124 | 129 | 133 |
| 125 | 125 | 129 | 133 |
| 126 | 126 | 129 | 133 |
| 127 | 127 | 129 | 133 |
| 128 | 128 | 129 | 133 |
| 129 | 129 | 129 | 133 |
| 130 | 130 | 129 | 133 |
| 131 | 131 | 129 | 133 |
| 132 | 132 | 133 | 133 |
| 133 | 133 | 133 | 133 |
| 134 | 134 | 133 | 133 |
| 135 | 135 | 133 | 133 |
| 136 | 136 | 133 | 133 |
| 137 | 137 | 133 | 133 |
| 138 | 138 | 141 | 133 |
| 139 | 139 | 141 | 133 |
| 140 | 140 | 141 | 133 |
| 141 | 141 | 141 | 133 |

FIG.13D

| Input | Output | | |
|---|---|---|---|
| | Gray level group 1 | Gray level group 2 | Gray level group 3 |
| 142 | 142 | 141 | 149 |
| 143 | 143 | 141 | 149 |
| 144 | 144 | 141 | 149 |
| 145 | 145 | 149 | 149 |
| 146 | 146 | 149 | 149 |
| 147 | 147 | 149 | 149 |
| 148 | 148 | 149 | 149 |
| 149 | 149 | 149 | 149 |
| 150 | 150 | 149 | 149 |
| 151 | 151 | 149 | 149 |
| 152 | 152 | 149 | 149 |
| 153 | 153 | 149 | 149 |
| 154 | 154 | 159 | 149 |
| 155 | 155 | 159 | 149 |
| 156 | 156 | 159 | 149 |
| 157 | 157 | 159 | 149 |
| 158 | 158 | 159 | 149 |
| 159 | 159 | 159 | 169 |
| 160 | 160 | 159 | 169 |
| 161 | 161 | 159 | 169 |
| 162 | 162 | 165 | 169 |
| 163 | 163 | 165 | 169 |
| 164 | 164 | 165 | 169 |
| 165 | 165 | 165 | 169 |
| 166 | 166 | 165 | 169 |
| 167 | 167 | 165 | 169 |
| 168 | 168 | 169 | 169 |
| 169 | 169 | 169 | 169 |
| 170 | 170 | 169 | 169 |
| 171 | 171 | 169 | 169 |
| 172 | 172 | 169 | 169 |
| 173 | 173 | 169 | 169 |
| 174 | 174 | 169 | 169 |
| 175 | 175 | 169 | 169 |
| 176 | 176 | 169 | 169 |
| 177 | 177 | 169 | 169 |
| 178 | 178 | 185 | 169 |
| 179 | 179 | 185 | 169 |
| 180 | 180 | 185 | 169 |
| 181 | 181 | 185 | 169 |
| 182 | 182 | 185 | 169 |
| 183 | 183 | 185 | 169 |
| 184 | 184 | 185 | 169 |
| 185 | 185 | 185 | 169 |
| 186 | 186 | 185 | 201 |
| 187 | 187 | 185 | 201 |
| 188 | 188 | 185 | 201 |

FIG.13E

| Input | Output | | |
|---|---|---|---|
| | Gray level group 1 | Gray level group 2 | Gray level group 3 |
| 189 | 189 | 185 | 201 |
| 190 | 190 | 193 | 201 |
| 191 | 191 | 193 | 201 |
| 192 | 192 | 193 | 201 |
| 193 | 193 | 193 | 201 |
| 194 | 194 | 193 | 201 |
| 195 | 195 | 193 | 201 |
| 196 | 196 | 197 | 201 |
| 197 | 197 | 197 | 201 |
| 198 | 198 | 197 | 201 |
| 199 | 199 | 201 | 201 |
| 200 | 200 | 201 | 201 |
| 201 | 201 | 201 | 201 |
| 202 | 202 | 201 | 201 |
| 203 | 203 | 201 | 201 |
| 204 | 204 | 201 | 201 |
| 205 | 205 | 201 | 201 |
| 206 | 206 | 201 | 201 |
| 207 | 207 | 211 | 201 |
| 208 | 208 | 211 | 201 |
| 209 | 209 | 211 | 201 |
| 210 | 210 | 211 | 201 |
| 211 | 211 | 211 | 201 |
| 212 | 212 | 211 | 223 |
| 213 | 213 | 211 | 223 |
| 214 | 214 | 211 | 223 |
| 215 | 215 | 211 | 223 |
| 216 | 216 | 219 | 223 |
| 217 | 217 | 219 | 223 |
| 218 | 218 | 219 | 223 |
| 219 | 219 | 219 | 223 |
| 220 | 220 | 219 | 223 |
| 221 | 221 | 219 | 223 |
| 222 | 222 | 223 | 223 |
| 223 | 223 | 223 | 223 |
| 224 | 224 | 223 | 223 |
| 225 | 225 | 223 | 223 |
| 226 | 226 | 223 | 223 |
| 227 | 227 | 223 | 223 |
| 228 | 228 | 223 | 223 |
| 229 | 229 | 223 | 223 |
| 230 | 230 | 223 | 223 |
| 231 | 231 | 239 | 223 |
| 232 | 232 | 239 | 223 |
| 233 | 233 | 239 | 223 |
| 234 | 234 | 239 | 223 |
| 235 | 235 | 239 | 223 |

FIG.13F

| Input | Output | | |
|---|---|---|---|
| | Gray level group 1 | Gray level group 2 | Gray level group 3 |
| 236 | 236 | 239 | 223 |
| 237 | 237 | 239 | 223 |
| 238 | 238 | 239 | 223 |
| 239 | 239 | 239 | 255 |
| 240 | 240 | 239 | 255 |
| 241 | 241 | 239 | 255 |
| 242 | 242 | 239 | 255 |
| 243 | 243 | 239 | 255 |
| 244 | 244 | 239 | 255 |
| 245 | 245 | 239 | 255 |
| 246 | 246 | 239 | 255 |
| 247 | 247 | 239 | 255 |
| 248 | 248 | 255 | 255 |
| 249 | 249 | 255 | 255 |
| 250 | 250 | 255 | 255 |
| 251 | 251 | 255 | 255 |
| 252 | 252 | 255 | 255 |
| 253 | 253 | 255 | 255 |
| 254 | 254 | 255 | 255 |
| 255 | 255 | 255 | 255 |

DRIVING APPARATUS FOR PLASMA DISPLAY PANEL AND A GRAY LEVEL EXPRESSING METHOD THEREOF

CROSS REFERENCE TO RELATED APPLICATION

This application claims priority to and the benefit of Korea Patent Application No. 10-2003-0072316 filed on Oct. 16, 2003 in the Korean Intellectual Property Office, the entire content of which is incorporated herein by reference.

BACKGROUND OF THE INVENTION (a) Field of the Invention

The present invention relates to a driving apparatus for a plasma display panel and a gray level expressing method thereof, and more particularly, to a driving apparatus for a plasma display panel and a gray level expressing method thereof that can reduce pseudo-contour.

(b) Description of the Related Art

Flat panel displays, such as a liquid crystal display (LCD), a field emission display (FED), a plasma display panel, or the like, have been developed recently. Among the flat panel displays, the plasma display panel has an advantage in that it has a wide visual range and that the brightness and light-emitting efficiency are high in comparison with other types of flat panel displays. The plasma display panel is in the spotlight as a display that can be substituted for the conventional cathode ray tube (CRT), especially in the large-sized displays of greater than forty inches.

The plasma display panel is a flat panel display that can display characters or images using plasma generated by gas discharge, on which hundreds of thousands or millions of pixels are arranged in a matrix format according to the size thereof. Such a plasma display panel is classified as a direct current type or an alternating current type according to the structure of discharging cells and the shape of the waveform of the driving voltage applied thereto.

The direct current type of plasma display panel has a shortcoming in that a current flows in a discharge space while the voltage is being applied as the electrodes are exposed to the outside while the discharge space is not insulated. Because of this a resistor for confining the current needs to be implemented. On the other hand, the alternating current type plasma display panel has an advantage in that the current is confined by capacitance formed naturally and the electrodes are protected by the impact from ions during the discharge by the dielectric layer covering the electrodes, so the lifetime is longer than that of the direct current type.

FIG. 1 is a partial perspective view of an alternating current type of plasma display panel. As shown in FIG. 1, scan electrodes 5 and sustain electrodes 5 covered by dielectric layer 2 and protection layer 3 are formed parallel in pairs on glass substrate 1. A plurality of address electrodes 8 covered by insulation layer 7 are formed on another glass substrate 6. Partitioning walls 9 are formed in parallel with address electrodes 8 on insulation layer 7 between address electrodes 8, and fluorescent substances 10 are formed on the surface of insulating layer 7 and both sides of partitioning walls 9. Glass substrates 1, 6 face each other with discharge spaces 11 between them so that scan electrodes 4 and sustain electrodes 5 are perpendicular to address electrodes 8. The discharge space near the intersection between address electrode 8 and scan electrode 4 and sustain electrode 5 that are coupled with each other forms discharge cell 12.

FIG. 2 shows an arrangement of the electrodes in the plasma display panel. As shown in FIG. 2, the electrodes in the plasma display panel are arranged in an m×n matrix form, and more particularly, address electrodes A1-Am are arranged in a column direction and n rows of the scan electrodes Y1-Yn and the sustain electrodes X1-Xn are arranged alternately in a row direction. Discharge cell 12 in FIG. 2 corresponds to discharge cell 12 in FIG. 1.

The driving period of such an alternating current type plasma display panel includes a reset time, an addressing time, and a sustain time according to the time flow of the change of the operation.

The reset time is the period to initialize the status of the respective cells in order to enhance the performance of the addressing operation of the cells, and the addressing time is the period to form a wall charge by applying the address voltage to the cells to be turned on (addressed cell) in order to select the cells to be turned on and not to be turned on in the panel. The sustain time is the discharge period for displaying the image actually on the addressed cells by applying sustain pulses.

As shown in FIG. 3, the plasma display panel realizes the gray level by dividing one frame (e.g., 1TV field) to a, plurality of subfields and then performing time-divisional control thereon. The respective subfields include the reset time, the addressing time, and the sustain time as described above. FIG. 3 shows the case in which one frame is divided into eight subfields in order to realize 256 gray levels. The respective subfields SF1-SF8 include a reset time (not shown), addressing time Ad1-Ad8, and a sustain time S1-S8, and in the sustain time S1-S8, the ratio of illuminating times 1T, 2T, 4T, . . . , and 128T is 1:2:4:8:16:32:64:128.

In such a situation, in order to realize the gray level of 3 for example, the sum of the discharging time is made to be 3T by discharging the discharge cells at subfield SF1 having illuminating time 1T and subfield SF2 having illuminating time 2T. The image of 256 gray levels can be realized by combining the subfields having different illuminating times as such.

However, while a moving picture is being displayed according to such a subfield method, pseudo-contour is generated due to the visual characteristics of a person. FIG. 4 shows an example of generated pseudo-contour. When an image in which gray level 127 and gray level 128 exist adjacently is moving rightward, such a status is expressed as FIG. 4 according to the subfield arrangement of FIG. 3. In such a situation, a person recognizes the gray levels in the direction of the dashed arrows shown in FIG. 4 according to the characteristics of the visual sense of the person that follows the movement of the image. Thus, a pseudo-contour such as the gray level 255 between the positions of gray levels 127 and 128 may occur.

SUMMARY OF THE INVENTION

In accordance with the present invention a driving apparatus for a plasma display panel and a method for expressing gray level thereof is provided that can reduce the pseudo-contour.

In one aspect of the present invention, there is provided a driving apparatus for a plasma display panel that divides each field of an image displayed on the plasma display panel according to an input image signal into a plurality of subfields and displays the image corresponding to the image signal by expressing gray levels using a combination of the subfields, the driving apparatus comprising a pseudo-contour detector, a gray level group portion, and an error diffuser. The pseudo-contour detector detects pseudo-contour by comparing illuminating patterns of the subfields and the gray levels of a present frame and a precedent frame. The gray level group portion changes the gray levels of the input image signal differently with respect to a plurality of gray level groups previously prepared, according to information of a degree of the pseudo-contour of the input image signal detected by the pseudo-contour detector. The error diffuser performs error diffusion differently at every gray level group with respect to differences of the gray levels of the input image signal and the gray levels of the image signal output from the gray level group portion.

According to another aspect of the present invention, there is provided a method for expressing gray levels of a plasma display panel that divides each field of an image displayed on the plasma display panel according to an input image signal into a plurality of subfields and displays the image corresponding to the image signal by expressing gray levels using a combination of the subfields. In the method, pseudo-contour is detected by comparing illuminating patterns of the subfields and the gray levels of a present frame and a precedent frame. The gray levels of the input image signal are changed differently with respect to a plurality of gray level groups previously prepared, according to information of degree of the pseudo-contour of the input image signal detected in (a). Error diffusion is performed differently at every gray level group with respect to differences of the gray levels of the input image signal and the gray levels of the image signal output in (b).

BRIEF DESCRIPTION OF THE DRAWINGS

FIGS. 13A to 13F show an example of a look-up table of the gray level group portion.

DETAILED DESCRIPTION

Figure 5:
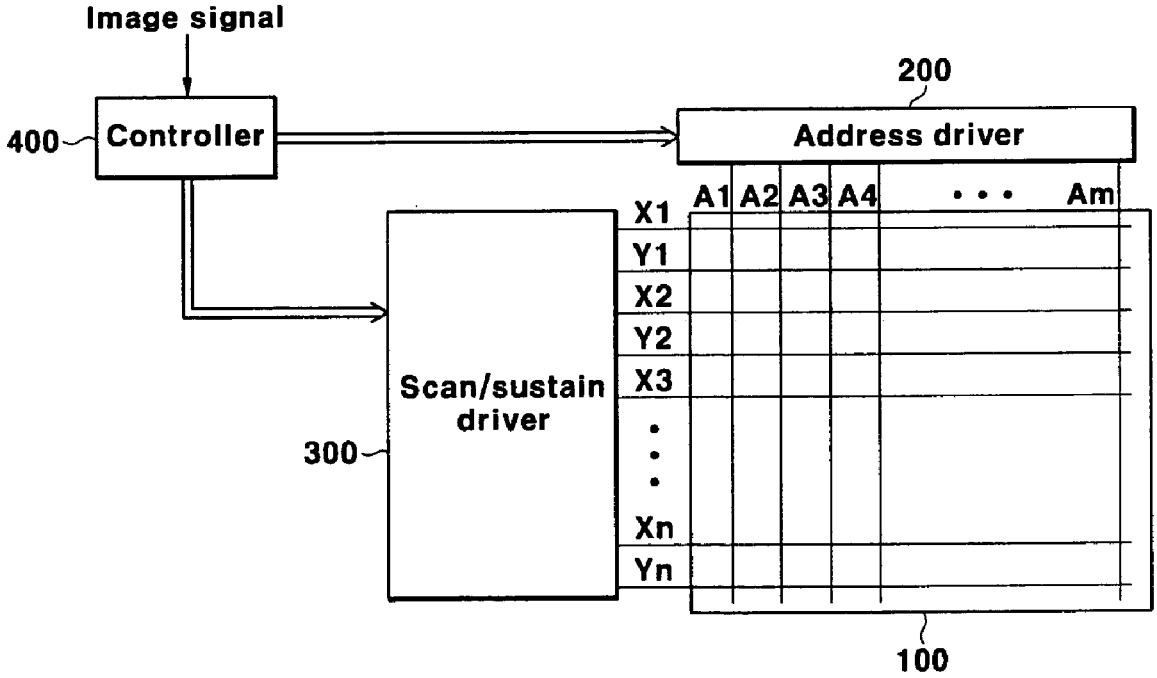
FIG. 5 is a schematic view of a plasma display panel according to an exemplary embodiment of the present invention.

As shown in FIG. 5, the plasma display panel according to the embodiment of the present invention includes plasma panel 100, address driver 200, scan/sustain driver 300, and controller 400.

Plasma display panel 100 includes a plurality of address electrodes A1-Am that are arranged in a column direction, and a plurality of scan electrodes Y1-Yn and sustain electrodes X1-Xn that are alternately arranged in a row direction. Address driver 200 receives address driving control signals from controller 400, and applies display data signals for selecting discharge cells to be illuminated to the respective address electrodes A1-Am. Scan/sustain driver 300 receives the control signals from controller 400 and inputs the sustain voltages to scan electrodes Y1-Yn and sustain electrodes X1-Xn to perform the sustain discharge with respect to the selected discharge cells.

Controller 400 receives Red/Green/Blue (R/G/B) image signals and a synchronization signal from outside and divides one frame into several subfields, and then divides the respective subfields into a reset time, addressing time, and sustain/discharge time to drive the plasma display panel. In such a situation, controller 400 adjusts the number of sustain pulses applied in each of the sustain times of the subfields in one frame so as to supply address driver 200 and scan/sustain driver 300 with the required control signal.

Controller 400 according to an exemplary embodiment of the present invention will now be described in greater detail with reference to FIGS. 6 through 13.

Figure 6:
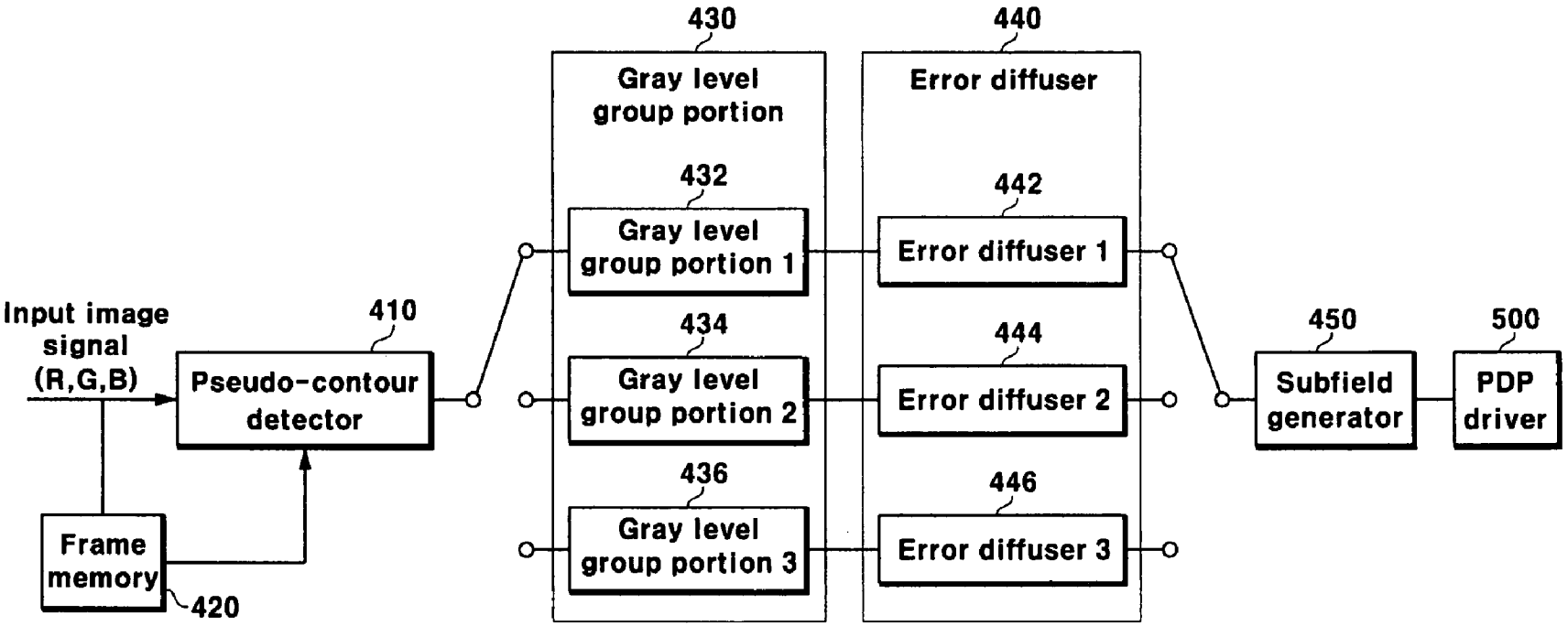
FIG. 6 is a schematic block diagram of a controller of the plasma display panel according to an exemplary embodiment of the present invention.

FIG. 6 is a schematic block diagram of controller 400 of the plasma display panel according to an exemplary embodiment of the present invention. As shown in FIG. 6, the controller of the plasma display panel according to the exemplary embodiment of the present invention includes pseudo-contour detector 410, frame memory 420, gray level group portion 430, error diffuser 440, and subfield generator 450.

Pseudo-contour detector 410 detects the pseudo-contour information of a moving picture using the input image signal data of two frames input consecutively. In such a situation, the image data of a precedent frame has to be stored in order to compare the images of two frames, that is, a present frame and the precedent frame, so as to use the image data of two successive frames. For such a purpose, frame memory 420 stores the image data of the precedent frame.

Figure 7A:
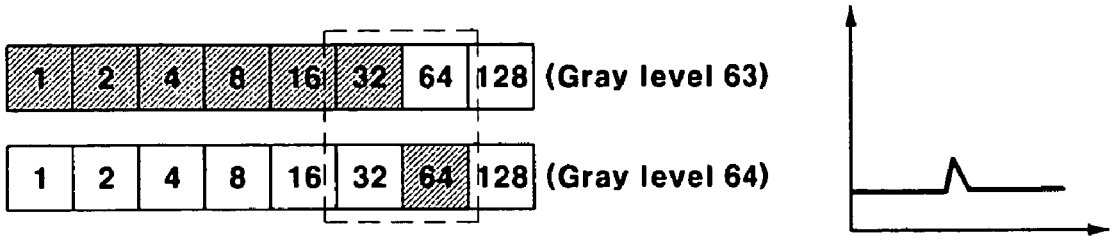
FIGS. 7A and 7B show examples of a pattern that may generate pseudo-contour.
Figure 7B:
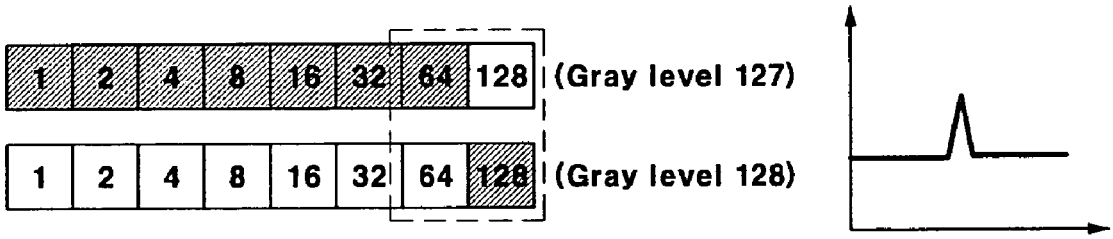

The probability of generation of the pseudo-contour increases when the illuminating patterns of subfields, i.e. the distribution pattern of coding, are different while the gray levels of two successive frames are similar. Furthermore, the probability of generation of the pseudo-contour at the moving picture increases more when the weights of the subfields with different illuminated states are greater. FIGS. 7A and 7B show examples of a pattern that may generate pseudo-contour, in which the case in FIG. 7A shows the quantity of pseudo-contour when the weight is 64 and the illuminating patterns are different, and the case in FIG. 7B shows the quantity of pseudo-contour when the weight is 128 and the illuminating patterns are different. In other words, the case in FIG. 7A shows the quantity of pseudo-contour when the gray level of the precedent frame is 63 and the gray level of the present frame is 64, and the case in FIG. 7B shows the quantity of pseudo-contour when the gray level of the precedent frame is 127 and the gray level of the present frame is 128. The peak values at the graphs at the cases in FIGS. 7A and 7B show the quantity of pseudo-contour, in which the pseudo-contour is generated much more when the weight is 128 and the illuminating patterns are different as shown in FIG. 7B.

Pseudo-contour detector 410 detects the degree of pseudo-contour in the moving picture according to the above principle. That is, pseudo-contour detector 410 compares the illuminating patterns regarding the gray levels of the pixels of the present frame at the same position of the pixels of the precedent frame, and determines the large quantity of pseudo-contour when the weight is large and the illuminating patterns are different.

The detailed method that pseudo-contour detector 410 detects the pseudo-contour is as follows. Equation (1) shows the method to calculate the quantity of pseudo-contour at a certain pixel.

$$\text{coding_criterion}(x, y) = \left(\sum_{p=1}^{m} |B_{i_n}(p) - B_{i_{n-1}}(p)| \times SP(p) - |i_n(x, y) - i_{n-1}(x, y)|\right) \times \text{weight}[i_n(x, y)] \quad \text{[Equation (1)]}$$

In the Equation (1), $i_n(x,y)$ designates the gray level at the (x,y) position of the present frame, and $i_{n-1}(x,y)$ designates the gray level at the (x,y) position of the precedent frame. $B_{in}(p)$ and $B_{in-1}(p)$ are the values when the illuminating pattern information of the p-th subfield with respect to the $i_n(x,y)$ and $i_{n-1}(x,y)$ are expressed as 0 and 1. SP(p) designates the weight of the p-th subfield, and m designates the number of subfields. In such a situation, the difference of gray levels of the precedent frame and the present frame (which means the absolute value of $i_n(x,y)-i_{n-1}(x,y)$) is subtracted as shown in Equation (1), because the smaller the gray level difference between the precedent frame and the present frame becomes, the larger the quantity of pseudo-contour becomes.

Furthermore, the weight $[i_n(x,y)]$ designates the weights at the respective gray levels determined according to the present gray level value. Generally, the visual sense of a person is more sensitive to a luminance difference at a dark area. That is, even at the same quantity of pseudo-contour, the pseudo-contour at a dark area is more disagreeable to the eyes than that at a bright area. Accordingly, predetermined weights weight $[i_n(x,y)]$ for respective gray levels are multiplied as in the Equation (1) in order to consider such a phenomenon. In that situation, the weights for respective gray levels are predetermined to be greater at the darker gray levels.

The Equation (1) shows the quantity of the pseudo-contour with respect to the respective pixels, and the final quantity of the pseudo-contour is as in the following Equation (2).

$$\text{coding_criterion}(\text{frame}) = \frac{1}{N \times M} \sum_{x=0}^{N} \sum_{y=0}^{M} \text{coding_criterion}(x, y) \quad \text{Equation (2)}$$

In Equation (2), N designates the number of scanning lines of a plasma display panel, and M designates the number of address lines. Accordingly, the quantity of pseudo-contour regarding to the entire screen on the plasma display panel can be calculated by Equation (2).

Gray level group portion 430 estimates the probability of generation of the pseudo-contour through the pseudo-contour simulation at every gray level before constituting the system as shown in FIG. 6, and converts the gray levels of the input image signal differently for every gray group according to the information on whether the pseudo-contour of the input image signal occurred determined by pseudo-contour detector 410 by using classified gray level groups.

The method for classifying the gray level groups according to the simulation method to estimate the probability of generation of pseudo-contour is now described.

Figure 8:
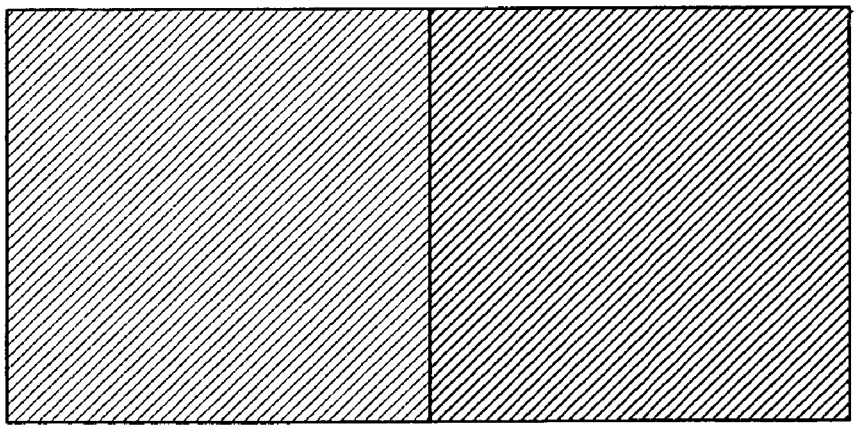
FIG. 8 is an image displayed on the plasma display panel in order to estimate the probability of generation of pseudo-contour.

FIG. 8 shows an image displayed on the plasma display panel in order to estimate the probability of generation of pseudo-contour. In FIG. 8, the quadrangles at the left and the right have the same gray levels.

Figure 9:
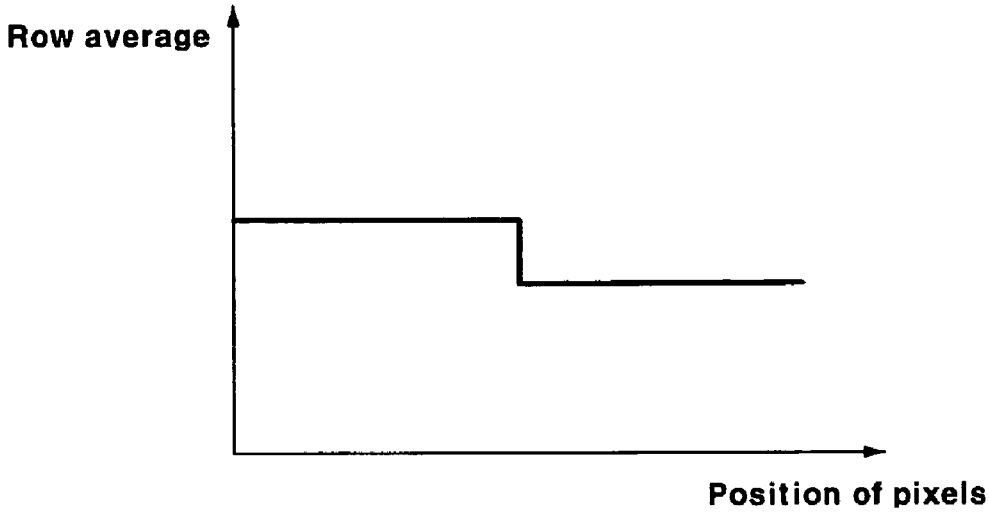
FIG. 9 is a graph showing the calculated result of average gray level with respect to the respective rows when the test image as shown in FIG. 8 is displayed.

FIG. 9 is a graph showing the calculated result of average gray level with respect to the respective rows when the test image as shown in FIG. 8 is displayed. As shown in FIG. 9, the row average gray levels at the left quadrangle part and the right quadrangle part are divided from each other.

Figure 1:
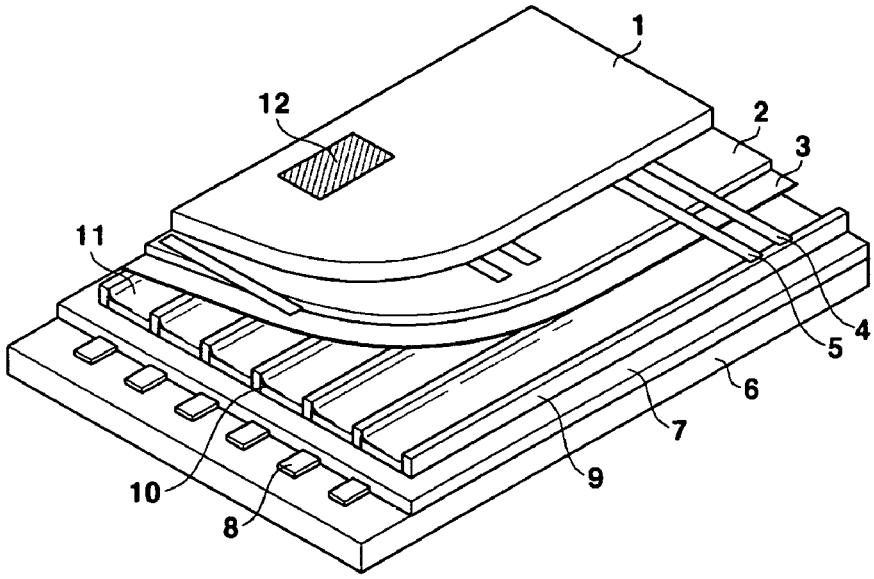
FIG.1 (Prior Art)
FIG. 1 is a partial perspective view of alternating current type of plasma display panel.
Figure 2:
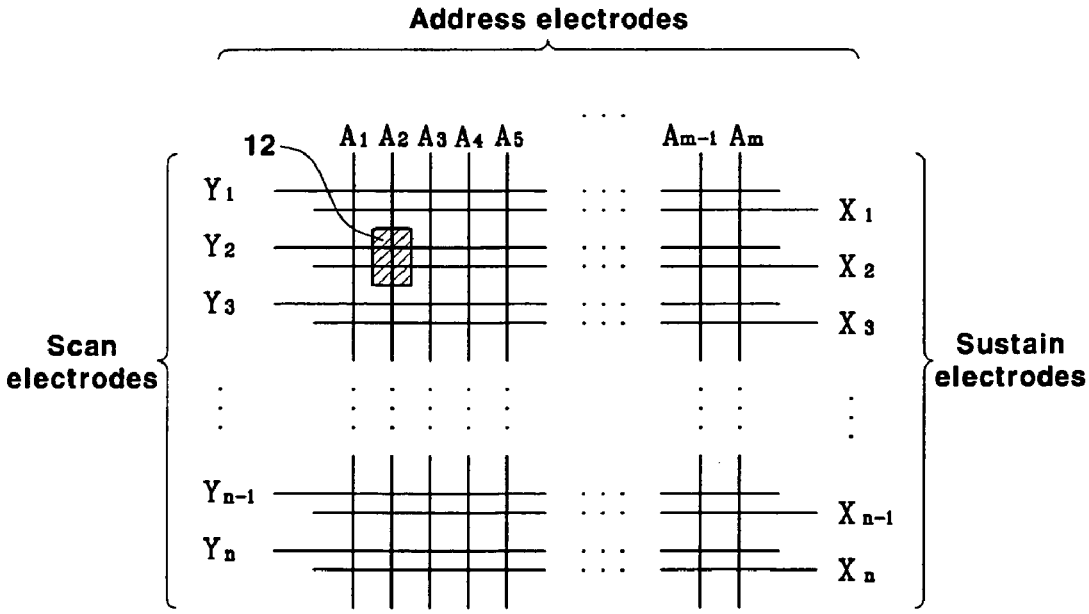
FIG.2 (Prior Art)
FIG. 2 is a schematic depiction of the electrode arrangement of an alternating current type plasma display panel.
Figure 3:
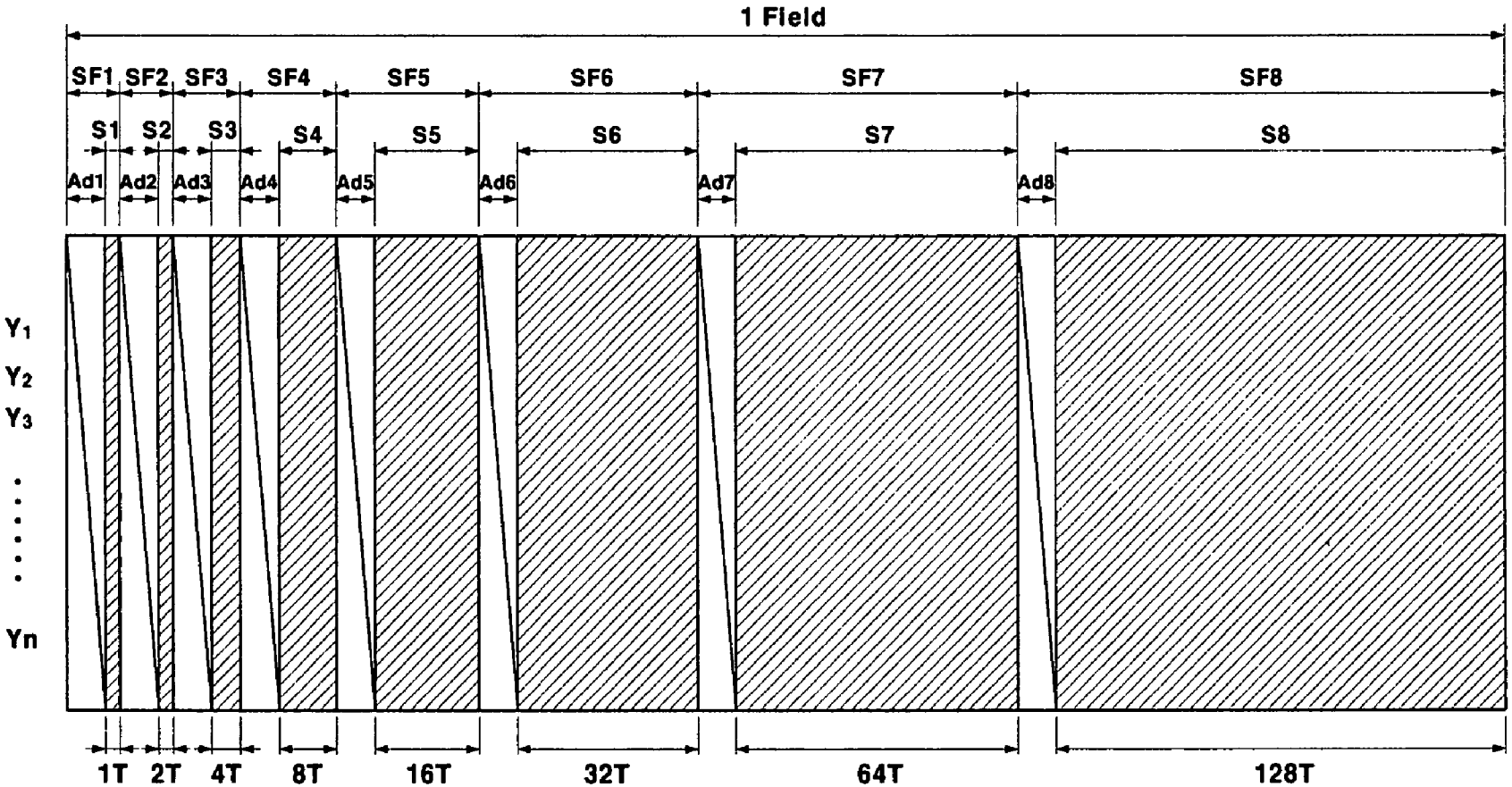
FIG.3 (Prior Art)
FIG. 3 shows the gray level expressing method of a plasma display panel.
Figure 4:
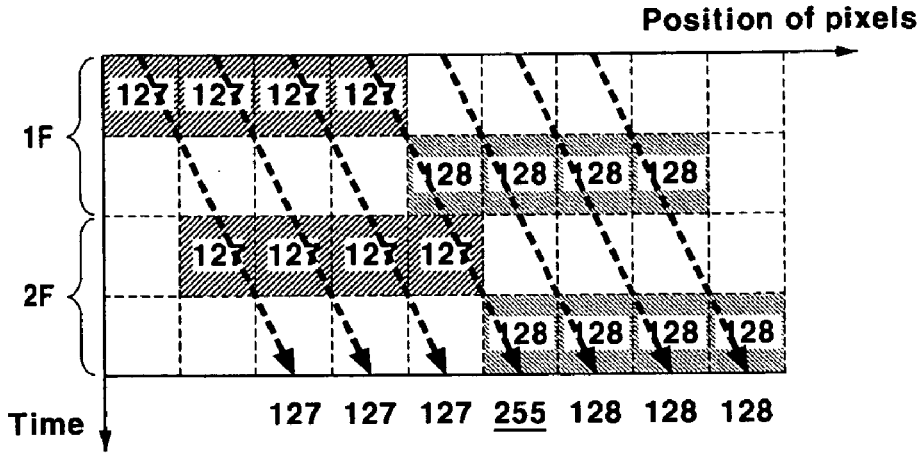
FIG.4 (Prior Art)
FIG. 4 shows an example of pseudo-contour actually generated.
Figure 10A:
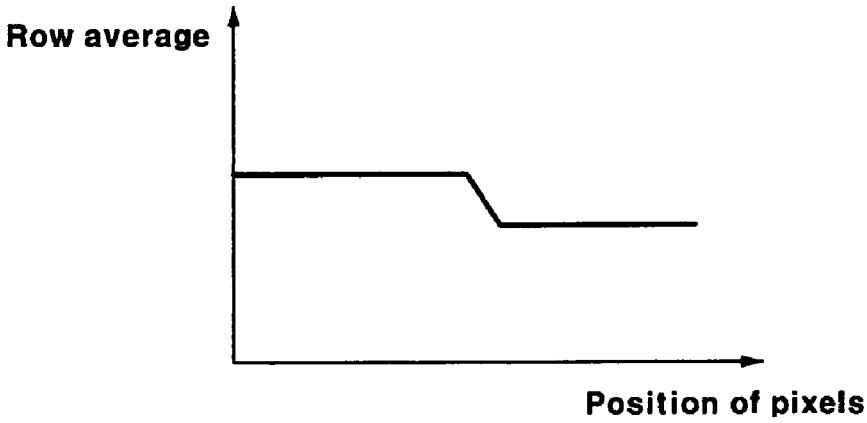
FIG. 10A is a graph showing the row average gray level when the pseudo-contour is not generated.
Figure 10B:
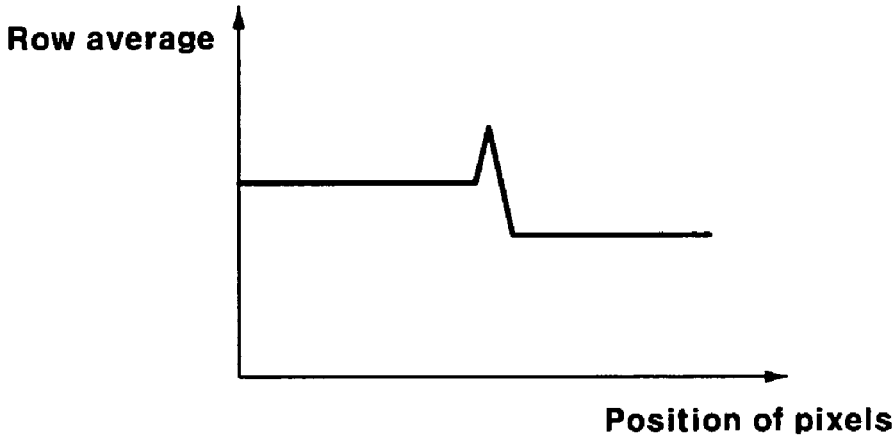
FIG. 10B is a graph showing the row average gray level when the pseudo-contour is generated.

In order to determine whether the pseudo-contour of a moving picture has occurred at the test image, the simulation result image is calculated through the simulation method moving rightward as described with reference to FIG. 4. In such a situation, the pseudo-contour may occur or not according to the arrangement of subfields and the gray levels that the test image as shown in FIG. 8 has. FIG. 10A is a graph showing the row average gray level when the pseudo-contour is not generated, and FIG. 10B is a graph showing the row average gray level when the pseudo-contour is generated. The row average gray level in the simulation result has the row average gray level values as shown in FIG. 10A when the pseudo-contour is not generated, and the row average gray level values will deviate from the gray level values of the original image as shown in FIG. 10B when the pseudo-contour is generated.

By using the simulation result of the test image shown in FIGS. 8 through 10B, the quantity of pseudo-contour of the corresponding test image is expressed as FC(P,Q), and the quantity of pseudo-contour is estimated through the following Equation (3).

```
if (Max_FC>max(P,Q))
FC(P,Q)=Max_FC−max(P,Q)
else if (Min_FC<min(P,Q))
FC(P,Q)=min(P,Q)−Min_FC
else
FC(P,Q)=0
```
[Equation (3)]

In the Equation (3), P and Q designate the left and the right gray levels of the test image as shown in FIG. 8, and Max_FC and Min_FC designate the maximum and minimum values at the row average gray levels of the simulation image. Further, max(P,Q) means the higher value among P and Q, and min(P,Q) means the lower value among P and Q. In other words, the degree of deviation from the original gray level P and Q is estimated by applying the simulation result achieved by the process shown in FIGS. 8 through 10B to the Equation (3), in order to determine the quantity of pseudo-contour.

Figure 11:
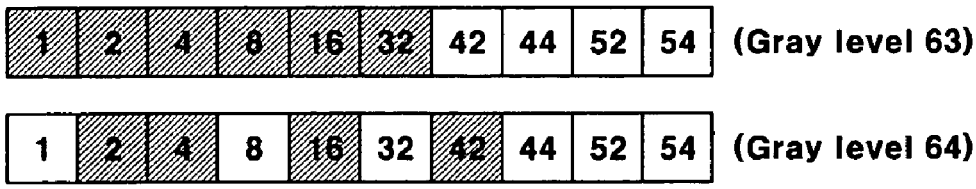
FIG. 11 shows the illuminating pattern of 63 and 64 gray levels at one example of the subfield arrangement.
Figure 12:
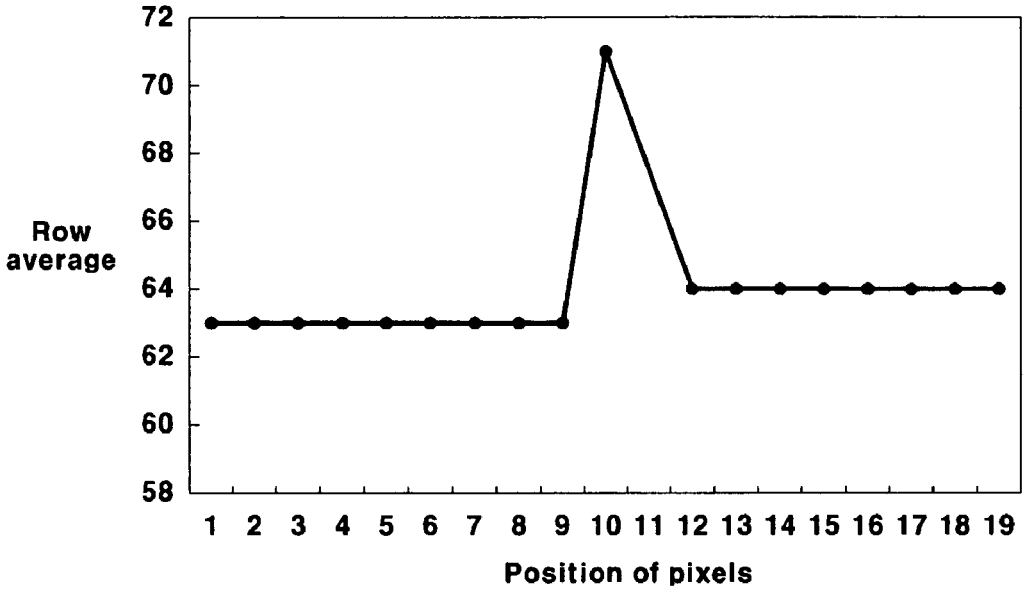
FIG. 12 is a graph showing the row average gray level calculated at the gray levels and the illuminating pattern as shown in FIG. 11.

For example, it is assumed that the illuminating pattern is as FIG. 11 when the subfield arrangement is [1 2 4 8 16 32 42 44 52 54], and P=63 and Q=64. The row average gray levels achieved by the simulation under such an assumption are calculated as FIG. 12. In that situation, max(P,Q)=64 and min(P,Q)=63, and Max_FC=71 and Min_FC=63 as depicted in FIG. 12. Accordingly, FC(P,Q)=Max_FC−max(P,Q)=71−64=7 in the Equation (3). As another example, since max(P,Q)=101 and min(P,Q)=100 when the simulation result is Max_FC=101 and Min_FC=100 in the case P=100 and Q=101, it is determined that the pseudo-contour is not generated as FC(P,Q)=0 as can be known in the Equation (3).

According to such a method, in consideration of the estimation of the quantity of pseudo-contour through the simulation (FIGS. 8 through 10B) and the Equation (3) with respect to all the cases of 256 gray levels of P and 256 gray levels of Q, FC(P,Q) are calculated with respect to all of the cases of 256×256. With FC(P,Q) calculated with respect to all of the cases of 256×256, the probability of pseudo-contour of the respective gray levels is calculated by the following Equation (4).

$$FC(x) = \sum_{P,Q=x} FC(P.Q) \quad \text{[Equation (4)]}$$

In the above Equation (4), x designates a certain gray level, and the probability of pseudo-contour regarding the gray level x is estimated by the sum of FC(P,Q) with respect to the cases that the gray level is x among P and Q. As the probability of pseudo-contour at the respective gray levels with respect to 256 gray levels is calculated by the Equation (4), a few gray level groups are achieved by classifying according to the calculated value. For example, the classification can be performed under the condition satisfying the following Equation (5) if three groups are to be achieved.

first gray level group: $FC(x) \leqq \max(FC(x))$ second gray level group: $FC(x) \leqq \max(FC(x)) - \{\max(FC(x)) + \min(FC(x))\} * 1/3$ third gray level group: $FC(x) \leqq \max(FC(x)) - \{\max(FC(x)) + \min(FC(x))\} * 2/3$ [Equation (5)]

All of the gray levels x can be classified into three gray level groups that satisfy the Equation (5). However, the number of gray level groups may not only be three, but can be greater than three in order to achieve more precise reduction of pseudo-contour. In the Equation 5, the first gray level group has 256 gray levels as all of the gray levels satisfy the Equation (5) since it is the case lower than the maximum value of the pseudo-contour. The second gray level group means the remaining gray levels other than the gray levels in which the pseudo-contour is extremely large. The third gray level group is the remaining gray levels in which even the gray level of a small quantity of pseudo-contour is excluded. In other words, the third gray level group has a lower probability of pseudo-contour in comparison with the second gray level group. In the aspect of the number of gray levels, the third gray level group has a smaller number of gray levels in comparison with the second gray level group.

In that situation, the respective gray levels are classified to a plurality of gray level groups as described above, and gray level group portion 430 has look-up tables for changing the gray levels in order to reduce the pseudo-contour according to the respective gray level groups. That is, referring back to FIG. 6, gray level group portion 430 includes first gray level group 432, second gray level group 434, and third gray level group 436, which respectively have look-up tables different from each other for changing the input gray levels separately at the first, second, and third gray level groups 432, 434, 436 with the gray level groups determined on the basis of the simulation result.

FIGS. 13A to 13F show an example of a look-up table of the gray level group portion. As shown in FIGS. 13A to 13F, different output gray levels are achieved at the first, second, and third gray level groups 432, 434, 436 even with the same input gray levels. For example, the look-up table is so configured that the output of the third gray level group is 149 with respect to the inputs 150 and 151. Since inputs 150 and 151 are not included in the third group, 149 is output as the adjacent value to inputs 150 and 151 and which corresponds to the third gray level group. As such, the first, second, and third gray level groups change the input gray levels with the look-up table of which output gray level values for reducing the pseudo-contour are different at every gray level group. Here, the look-up table shown in FIGS. 13A to 13F is only an example, and the present invention is not restricted to that example.

In other words, the gray levels are changed by first gray level group portion 432 when very little pseudo-contour is generated according to the detecting result of the generation of the pseudo-contour on the input image signal performed by pseudo-contour detector 410, and the gray levels are changed by third gray level group portion 436 when much pseudo-contour is generated. And, the gray levels are changed by second gray level group portion 434 when a middle degree of pseudo-contour is generated. In such a situation, the respective gray level group portions 432, 434, 436 have the look-up tables having the changing values of the respective gray levels according to the probability of pseudo-contour calculated by the simulation described above, and change the gray levels to reduce the pseudo-contour.

In such a situation, the output gray level values of gray level group portion 440 has error values with respect to the input gray level values. Furthermore, the error values are different at first, second, and third gray level groups 442, 444, 446 included in the gray level group portion 440. In order to correct the error values, error diffuser 440 as shown in FIG. 6 is used.

Error diffuser 440 includes first error diffuser 442, second error diffuser 444, and third error diffuser 446. In such a situation, if the gray level group is classified to more than three gray level groups, the number of the error diffusers is changed according thereto. Error diffuser 440 outputs different values as it includes first, second, and third error diffusers 442, 444, 446 corresponding to the respective gray level group portions 432, 434, 436, and therefore, as the gray level differences, i.e. the errors, are different, the error diffusions are performed respectively after the generated errors are propagated to the adjacent pixels in order to correct the errors. The error diffusion is described in detail on the Korean laid-open patent No. 2002-0014766, so a detailed description thereof is omitted.

Subfield generator 450 generates the subfields conforming to the image signal data output from error diffuser 440. In other words, the subfields are determined on the basis of the ON/OFF determination of the respective subfields (which mean the respective subfields having different weight values) according to the image signal output from error diffuser 440.

The subfield data output from subfield generator 450 are transmitted to PDP driver 500, i.e. address driver 200 and scan/sustain driver 300, to be displayed on plasma display panel 100, as shown in FIG. 5.

As described above, according to the present invention, the gray levels are classified according to the degree of generation of the pseudo-contour through the simulation, the optimal look-up tables for reducing the pseudo-contour are prepared, and the look-up tables for changing the gray levels according to the degree of the pseudo-contour of the input image signal are selected differently, by which the pseudo-contour can be reduced more precisely.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus for a plasma display panel that divides each field of an image displayed on the plasma display panel according to an input image signal into a plurality of subfields and displays the image corresponding to the image signal by expressing gray levels using a combination of the subfields, the driving apparatus comprising:

a pseudo-contour detector for detecting pseudo-contour by comparing illuminating patterns of the subfields and the gray levels of a present frame and a precedent frame, the illuminating patterns being patterns in which the subfields are illuminated in respective said present and precedent frames;

a gray level group portion for changing the gray levels of the input image signal differently with respect to a plurality of gray level groups previously prepared, according to information of degree of the pseudo-contour of the input image signal detected by the pseudo-contour detector; and an error diffuser for performing error diffusion differently at every gray level group with respect to differences of the gray levels of the input image signal and the gray levels of an image signal output from the gray level group portion.

2. The driving apparatus of claim 1, wherein the gray level groups previously prepared are classified into a plurality of groups according to a probability of pseudo-contour.

3. The driving apparatus of claim 2, wherein the gray level group portion has look-up tables for performing gray level conversion differently at every gray level group.

4. The driving apparatus of claim 3, wherein the look-up table has information for performing gray level conversion according to the probability of pseudo-contour.

5. The driving apparatus of claim 1, further comprising a frame memory for storing image signal data of a frame precedent to a present frame.

6. A method for expressing gray level of a plasma display panel that divides each field of an image displayed on the plasma display panel according to an input image signal into a plurality of subfields and displays the image corresponding to the image signal by expressing gray levels using a combination of the subfields, the method comprising:

(a) detecting pseudo-contour by comparing illuminating patterns of the subfields and the gray levels of a present frame and a precedent frame, the illuminating patterns being patterns in which the subfields are illuminated in respective said present and precedent frames;

(b) changing the gray levels of the input image signal differently with respect to a plurality of gray level groups previously prepared, according to information of degree of the pseudo-contour of a detected input image signal and providing an output image signal; and (c) performing error diffusion differently at every gray level group with respect to differences of the gray levels of the input image signal and the gray levels of the output image signal.

7. The method of claim 6, wherein the gray level groups previously prepared are classified into a plurality of groups according to a probability of pseudo-contour.

8. The method of claim 6, wherein look-up tables for performing gray level conversion differently at every gray level group in order to reduce the pseudo-contour are prepared.

9. The method of claim 6, further comprising:

converting to the subfields corresponding to the image signal data output after the error diffusion; and controlling display on the plasma display panel so that the image corresponding to the data of the subfields is displayed on the plasma display panel.

10. The driving apparatus of claim 1, further comprising a subfield generator coupled to the error diffuser for converting to the subfields corresponding to image signal data output from the error diffuser.

11. The driving apparatus of claim 10, further comprising a plasma display panel driver coupled to the subfield generator and generating control signals for controlling display on the plasma display panel so that the image corresponding to the data of the subfields is displayed on the plasma display panel.

* * * * *